US011180874B2

(12) United States Patent
Martinet et al.

(10) Patent No.: US 11,180,874 B2
(45) Date of Patent: Nov. 23, 2021

(54) GARMENT WITH HIGHER COEFFICIENT OF FRICTION WHEN STRETCHED

(71) Applicant: Mast Industries (Far East) Limited, Kowloon (HK)

(72) Inventors: Nathalie Martinet, Saikung (HK); Suet Hing Yip, Tai Wai (HK)

(73) Assignee: Mast Industries (Far East) Limited, Kowloon (HK)

( * ) Notice: Subject to any disclaimer, the term of this patent is extended or adjusted under 35 U.S.C. 154(b) by 247 days.

(21) Appl. No.: 16/387,111

(22) Filed: Apr. 17, 2019

(65) Prior Publication Data

US 2019/0323153 A1 Oct. 24, 2019

Related U.S. Application Data

(60) Provisional application No. 62/680,161, filed on Jun. 4, 2018, provisional application No. 62/660,770, filed on Apr. 20, 2018.

(51) Int. Cl.

| | |
|---|---|
| ***D04B 21/20*** | (2006.01) |
| ***A41C 3/12*** | (2006.01) |
| ***D04B 21/16*** | (2006.01) |

(52) U.S. Cl.

CPC ..... *D04B 21/207* (2013.01); *A41C 3/12* (2013.01); *D04B 21/16* (2013.01); *D10B 2331/10* (2013.01); *D10B 2501/00* (2013.01)

(58) Field of Classification Search

CPC .. D04B 21/16; D04B 21/207; D04B 2331/10; D04B 2501/00; D04B 21/18; A41B 2400/82; A41B 17/005; A41C 3/00; A41D 31/00; A41D 2400/82

See application file for complete search history.

(56) References Cited

U.S. PATENT DOCUMENTS

| | | | | | |
|---|---|---|---|---|---|
| 1,431,643 | A | * | 10/1922 | Fisher | D04B 1/26 66/180 |
| 1,811,843 | A | * | 6/1931 | Chisholm | D03D 15/58 139/421 |
| 1,896,783 | A | * | 2/1933 | Moore | D03D 15/56 139/421 |
| 2,149,071 | A | * | 2/1939 | Reynolds | D04B 1/06 66/197 |
| 2,524,620 | A | * | 10/1950 | Cadous | A41C 3/06 450/41 |

(Continued)

FOREIGN PATENT DOCUMENTS

| | | | |
|---|---|---|---|
| CN | 207331204 | U | 5/2018 |
| GB | 1396577 | A | 6/1975 |
| WO | 2019227900 | A1 | 12/2019 |

OTHER PUBLICATIONS

European Search Report issued in corresponding European Application No. 19170119.2, dated Sep. 16, 2019.

*Primary Examiner* — Jocelyn Bravo

(74) *Attorney, Agent, or Firm* — Andrus Intellectual Property Law, LLP

(57) ABSTRACT

A garment includes a fabric portion having an inner face that is configured to contact a wearer's body while the garment is worn. The fabric portion is configured to be stretched while the garment is worn on the wearer's body. A coefficient of friction of the inner face of the fabric portion is greater while the fabric portion is stretched on the wearer's body than while the fabric portion is not stretched.

16 Claims, 10 Drawing Sheets

(56) References Cited

U.S. PATENT DOCUMENTS 2,946,211 A * 7/1960 Morancy ..... D04B 1/18 66/200
2,988,087 A * 6/1961 Krieger ..... A41C 3/06 450/81
3,478,748 A * 11/1969 Bjorn-Larsen ..... A41C 1/003 450/111
3,983,870 A * 10/1976 Herbert ..... A41B 11/12 602/63
5,067,178 A * 11/1991 Katchka ..... A41B 9/001 2/250
5,412,957 A * 5/1995 Bradberry ..... A61F 13/08 2/239
5,885,910 A * 3/1999 Graichen ..... D04B 21/10 427/372.2
6,332,825 B1 * 12/2001 Henricksen ..... A41C 3/0057 450/1
7,228,809 B2 * 6/2007 Angelino ..... A41D 27/245 112/440
7,422,508 B2 * 9/2008 Bentham ..... A41C 3/0014 2/243.1
8,480,452 B2 * 7/2013 Reinisch ..... A41C 3/0014 450/39
9,358,172 B2 * 6/2016 Collins ..... A61H 1/008
9,565,877 B2 * 2/2017 Martinet ..... A41C 3/065
2005/0003736 A1 * 1/2005 Bentham ..... A41C 3/128 450/75
2005/0266770 A1 * 12/2005 Henricksen ..... A41C 3/0007 450/1
2007/0238392 A1 * 10/2007 Starbuck ..... D04B 21/207 450/1
2008/0041113 A1 * 2/2008 Mori ..... A41B 11/02 66/54
2008/0261490 A1 * 10/2008 Scheininger ..... A41C 3/12 450/39
2009/0047481 A1 * 2/2009 Welsch ..... D06M 23/18 428/179
2010/0093258 A1 * 4/2010 Glenn ..... D03D 17/00 450/86
2010/0183814 A1 * 7/2010 Rios ..... A63B 60/00 427/387
2010/0248575 A1 * 9/2010 Malz ..... D01D 5/38 442/327
2011/0076906 A1 * 3/2011 Cheung ..... D03D 15/56 442/184
2014/0259304 A1 * 9/2014 Mitchell ..... A41C 3/0057 2/400
2014/0287652 A1 * 9/2014 Deguchi ..... A41C 3/0057 450/86
2015/0111466 A1 * 4/2015 Martinet ..... A41C 3/065 450/41
2015/0196064 A1 * 7/2015 Melarti ..... A41B 9/04 450/95
2016/0002845 A1 * 1/2016 He ..... D06M 15/643 442/314
2017/0099884 A1 * 4/2017 Martinet ..... A41C 3/12
2018/0310643 A1 * 11/2018 Hanson Allen ..... D02G 3/328
2019/0223521 A1 * 7/2019 Ikuta ..... A41C 3/0007

* cited by examiner

| 100% Spandex Fabric | | | | |
|---|---|---|---|---|
| % Stretch | Stretch Direction-Test Direction | Coefficient of max static friction | Coefficient of kinetic friction | % Increase from rest state |
| Rest | L-L average | 0.533 | 0.458 | NA |
| 20% | L-L average | 0.532 | 0.463 | 1.140 |
| 40% | L-L average | 0.536 | 0.473 | 3.464 |
| 100% | L-L average | 0.538 | 0.492 | 7.567 |
| Rest | W-W Average | 0.523 | 0.456 | NA |
| 20% | W-W Average | 0.520 | 0.455 | -0.164 |
| 40% | W-W Average | 0.513 | 0.455 | -0.157 |
| 100% | W-W Average | 0.514 | 0.466 | 2.193 |
| Rest | L-W Average | 0.523 | 0.456 | NA |
| 20% | L-W Average | 0.491 | 0.422 | -7.413 |
| 40% | L-W Average | 0.484 | 0.424 | -7.055 |
| 100% | L-W Average | 0.460 | 0.423 | -7.321 |
| Rest | W-L Average | 0.533 | 0.458 | NA |
| 20% | W-L Average | 0.498 | 0.413 | -9.623 |
| 40% | W-L Average | 0.485 | 0.414 | -9.586 |
| 100% | W-L Average | 0.476 | 0.419 | -8.379 |

FIG. 5

| Fabric with Spandex Exposed on One Face | | | | |
|---|---|---|---|---|
| % Stretch | Stretch Direction-Test Direction | Coefficient of max static friction | Coefficient of kinetic friction | % Increase from rest state |
| Rest | L-L average | 0.688 | 0.671 | NA |
| 20% | L-L average | 0.726 | 0.716 | 6.730 |
| 40% | L-L average | 0.715 | 0.711 | 5.938 |
| 100% | L-L average | 0.711 | 0.701 | 4.464 |
| Rest | W-W Average | 0.665 | 0.659 | NA |
| 20% | W-W Average | 0.659 | 0.662 | 0.335 |
| 40% | W-W Average | 0.675 | 0.671 | 1.795 |
| 100% | W-W Average | 0.676 | 0.664 | 0.641 |
| Rest | L-W Average | 0.665 | 0.659 | NA |
| 20% | L-W Average | 0.670 | 0.663 | 0.613 |
| 40% | L-W Average | 0.659 | 0.635 | -3.642 |
| 100% | L-W Average | 0.677 | 0.633 | -3.986 |
| Rest | W-L Average | 0.688 | 0.671 | NA |
| 20% | W-L Average | 0.672 | 0.671 | -0.039 |
| 40% | W-L Average | 0.658 | 0.649 | -3.246 |
| 100% | W-L Average | 0.658 | 0.665 | -0.935 |

FIG. 6

| Fabric 1 – First Yarn is 20D/20F Nylon, Second Yarn is 30D Spandex, Third Yarn is 70D Spandex | | | | |
|---|---|---|---|---|
| % Stretch | Stretch Direction-Test Direction | Coefficient of max static friction | Coefficient of kinetic friction | % Increase from rest state |
| Rest | L-L average | 0.567 | 0.554 | NA |
| 20% | L-L average | 0.560 | 0.549 | -0.970 |
| 40% | L-L average | 0.549 | 0.534 | -3.668 |
| 100% | L-L average | 0.564 | 0.541 | -2.312 |
| Rest | W-W Average | 0.530 | 0.516 | NA |
| 20% | W-W Average | 0.535 | 0.519 | 0.590 |
| 40% | W-W Average | 0.533 | 0.517 | 0.066 |
| 100% | W-W Average | 0.556 | 0.525 | 1.707 |
| Rest | L-W Average | 0.530 | 0.516 | NA |
| 20% | L-W Average | 0.531 | 0.524 | 1.507 |
| 40% | L-W Average | 0.518 | 0.513 | -0.697 |
| 100% | L-W Average | 0.555 | 0.541 | 4.831 |
| Rest | W-L Average | 0.567 | 0.554 | NA |
| 20% | W-L Average | 0.543 | 0.532 | -4.018 |
| 40% | W-L Average | 0.539 | 0.527 | -4.927 |
| 100% | W-L Average | 0.521 | 0.518 | -6.568 |

FIG. 7

| Fabric 2 -- First Yarn is 20D/20F Nylon, Second Yarn is 30D Spandex, Third Yarn is 55D Spandex | | | | |
|---|---|---|---|---|
| % Stretch | Stretch Direction-Test Direction | Coefficient of max static friction | Coefficient of kinetic friction | % Increase from rest state |
| Rest | L-L average | 0.656 | 0.643 | NA |
| 20% | L-L average | 0.662 | 0.650 | 1.117 |
| 40% | L-L average | 0.665 | 0.641 | -0.228 |
| 100% | L-L average | 0.650 | 0.621 | -3.398 |
| Rest | W-W Average | 0.628 | 0.608 | NA |
| 20% | W-W Average | 0.619 | 0.597 | -1.786 |
| 40% | W-W Average | 0.615 | 0.589 | -3.147 |
| 100% | W-W Average | 0.600 | 0.584 | -3.946 |
| Rest | L-W Average | 0.628 | 0.608 | NA |
| 20% | L-W Average | 0.653 | 0.647 | 6.514 |
| 40% | L-W Average | 0.658 | 0.656 | 7.952 |
| 100% | L-W Average | 0.652 | 0.645 | 6.221 |
| Rest | W-L Average | 0.656 | 0.643 | NA |
| 20% | W-L Average | 0.653 | 0.647 | 0.672 |
| 40% | W-L Average | 0.621 | 0.618 | -3.801 |
| 100% | W-L Average | 0.610 | 0.605 | -5.959 |

FIG. 8

| Fabric 3 – First Yarn is 20D/20F Nylon, Second Yarn is 30D Spandex, Third Yarn is 40D Spandex | | | | |
|---|---|---|---|---|
| % Stretch | Stretch Direction-Test Direction | Coefficient of max static friction | Coefficient of kinetic friction | % Increase from rest state |
| Rest | L-L average | 0.566 | 0.544 | NA |
| 20% | L-L average | 0.546 | 0.524 | -3.761 |
| 40% | L-L average | 0.551 | 0.524 | -3.690 |
| 100% | L-L average | 0.579 | 0.542 | -0.462 |
| Rest | W-W Average | 0.532 | 0.506 | NA |
| 20% | W-W Average | 0.522 | 0.492 | -2.749 |
| 40% | W-W Average | 0.543 | 0.512 | 1.115 |
| 100% | W-W Average | 0.661 | 0.652 | 28.802 |
| Rest | L-W Average | 0.532 | 0.506 | NA |
| 20% | L-W Average | 0.553 | 0.531 | 4.838 |
| 40% | L-W Average | 0.551 | 0.531 | 4.809 |
| 100% | L-W Average | 0.558 | 0.537 | 6.001 |
| Rest | W-L Average | 0.566 | 0.544 | NA |
| 20% | W-L Average | 0.528 | 0.507 | -6.818 |
| 40% | W-L Average | 0.520 | 0.494 | -9.159 |
| 100% | W-L Average | 0.570 | 0.564 | 3.682 |

FIG. 9

| Fabric 4 – First Yarn is 12D/12F Nylon, Second Yarn is 30D Spandex, Third Yarn is 40D Spandex | | | | |
|---|---|---|---|---|
| % Stretch | Stretch Direction-Test Direction | Coefficient of max static friction | Coefficient of kinetic friction | % Increase from rest state |
| Rest | L-L average | 0.481 | 0.455 | NA |
| 20% | L-L average | 0.459 | 0.427 | -6.112 |
| 40% | L-L average | 0.466 | 0.438 | -3.612 |
| 100% | L-L average | 0.428 | 0.390 | -14.123 |
| Rest | W-W Average | 0.457 | 0.382 | NA |
| 20% | W-W Average | 0.466 | 0.422 | 10.584 |
| 40% | W-W Average | 0.474 | 0.429 | 12.370 |
| 100% | W-W Average | 0.530 | 0.484 | 26.751 |
| Rest | L-W Average | 0.457 | 0.382 | NA |
| 20% | L-W Average | 0.465 | 0.431 | 12.980 |
| 40% | L-W Average | 0.416 | 0.393 | 2.844 |
| 100% | L-W Average | 0.424 | 0.396 | 3.819 |
| Rest | W-L Average | 0.481 | 0.455 | NA |
| 20% | W-L Average | 0.409 | 0.367 | -19.303 |
| 40% | W-L Average | 0.410 | 0.372 | -18.060 |
| 100% | W-L Average | 0.466 | 0.452 | -0.550 |

FIG. 10

| Fabric 5 – First Yarn is 12D/10F Nylon, Second Yarn is 30D Spandex, Third Yarn is 40D Spandex | | | | |
|---|---|---|---|---|
| % Stretch | Stretch Direction-Test Direction | Coefficient of max static friction | Coefficient of kinetic friction | % Increase from rest state |
| Rest | L-L average | 0.588 | 0.584 | NA |
| 20% | L-L average | 0.582 | 0.573 | -1.895 |
| 40% | L-L average | 0.590 | 0.574 | -1.708 |
| 100% | L-L average | 0.641 | 0.615 | 5.274 |
| Rest | W-W Average | 0.550 | 0.534 | NA |
| 20% | W-W Average | 0.563 | 0.549 | 2.762 |
| 40% | W-W Average | 0.602 | 0.592 | 10.813 |
| 100% | W-W Average | 0.681 | 0.657 | 23.062 |
| Rest | L-W Average | 0.550 | 0.534 | NA |
| 20% | L-W Average | 0.563 | 0.564 | 5.498 |
| 40% | L-W Average | 0.578 | 0.575 | 7.679 |
| 100% | L-W Average | 0.597 | 0.584 | 9.389 |
| Rest | W-L Average | 0.588 | 0.584 | NA |
| 20% | W-L Average | 0.561 | 0.550 | -5.865 |
| 40% | W-L Average | 0.564 | 0.556 | -4.902 |
| 100% | W-L Average | 0.621 | 0.622 | 6.385 |

FIG. 11

GARMENT WITH HIGHER COEFFICIENT OF FRICTION WHEN STRETCHED

CROSS-REFERENCE TO RELATED APPLICATIONS

The present application claims the benefit of and priority to U.S. Provisional Application Nos. 62/660,770, filed on Apr. 20, 2018, and 62/680,161, filed on Jun. 4, 2018, which are hereby incorporated by reference herein in their entireties.

FIELD

The present disclosure relates to garments for which a tight-to-skin, clinging function is desirable, such as, but not limited to, brassieres, panties, shapewear, athletic wear, swimwear, leggings, tights, yoga wear, and other tight-fitting garments.

BACKGROUND

U.S. Pat. No. 9,358,172 discloses a therapeutic medical garment having a variable pressure profile along its length and including a knitted tubular body and a knitted anti-slip portion formed proximate one end of the tubular body with an inner surface adapted for residing against a wearer's skin. The knitted anti-slip portion includes at least first and second high friction yarns simultaneously knitted to form a repeat having a raised surface texture on the inner surface of the anti-slip portion. One of the first and second high friction yarns is a low-elasticity yarn, and at least one of the first and second high-friction yarns is knitted to reside on and form the raised surface texture on the inner face of the anti-slip portion.

U.S. Patent Application Publication No. 2016/0002845 discloses a method of producing fabrics which show a silk-like visual effect and soft hand-feel and retain such effects after being stretched and returned to their original size. This method combines a specific fabric structure and the treatment with a silicon oil in the finishing process. The particular fabric structure has nylon yarns which are close looped and elastic spandex yarns which are open looped.

U.S. Patent Application Publication No. 2011/0076906 relates to a knitted fabric which adopts a novel weaving principle of changing knitting material structure to realize functions and effects which can not be achieved by ordinary fabric. The knitted fabric comprises the main component of novel woven 100 percent spandex fabric made of 100 percent spandex filament. Presently, elastic rubber pieces, rubber bands, etc., are applied to the underwear at the market for enhancing the elasticity and supporting effect. The common features is that they all have a poor elastic resilience, unstable structure, and prone to distortion and raveling. The present novel knitted fabric changes the principle of crocheting of the ordinary material of the traditional knitted fabric, adopting 100 percent spandex filament as the main material to change the elastic resilience, force, and structure stability of the traditional knitted fabric. The mutual double pulling effect of the knitted fabric in the spandex filament after crocheting is to remedy the defaults of the fabric of which the structure is deformed and the elastic resilience and the force are weakened after the fabric is elongated. Compared with the original fabric, the elastic recovery and the elastic force of the fabric are greatly increased and improved.

U.S. Pat. No. 5,885,910 discloses a non-slip knitted lace fabric having opposed first and second surfaces of yarn and a stretchable tacky layer of cured and foamed, oleophobic and hydrophobic plastisol disposed at least partially on one of the first and second surfaces to provide enhanced frictional engagement of the fabric with a surface adjacent to the tacky layer. Preferably the fabric has a loop-forming yarn knitted therein so as to provide a plurality of loops of the loop-forming yarn as the one surface. The tacky layer extends through the openings of at least some of the loops. Optimally, the loop-forming yarn is elastic and tacky.

U.S. Pat. No. 5,412,957 discloses a therapeutic stocking for applying compressive force to the wearer's leg having an integrally knit anti-slip feature on the foot portion. The anti-slip feature being knit of bare and covered elastomeric yarns. The anti-slip feature further having an instep portion and a sole portion having greater frictional characteristics than the instep portion. The sole portion being knit in a repeating pattern having courses of knit and float stitches of a covered elastomeric yarn and jersey courses of a bare elastomeric yarn. The bare elastomeric yarn is substantially on the exterior surface of the sole portion and yields a friction surface which is located to contact the floor beneath the wearer's foot and minimize slippage thereon.

U.S. Pat. No. 3,983,870 discloses a body limb support comprising a limb encircling member comprising knitted thread wherein the outer parts of the knitted thread in a relaxed state on a substantial portion of the inner surface of the limb encircling member have attached thereto a nonadhesive, noncontinuous, relatively soft, elastomeric polymeric material with a high coefficient of friction to skin so as to provide a nonocclusive slip resistant surface capable of maintaining the support in place on the limb of the body.

U.S. Pat. No. 2,946,211 discloses knitted fabrics primarily intended for use in the manufacture of supporting garments, such as foundational garments, brassieres and the like. The knitted fabrics are suitable for the above purposes and are porous, attractive in appearance, light in weight and elastic so that garments made therefrom will furnish the desired support while conforming comfortably to the contour of the wearer's body.

GB Patent Application Publication No. 1,396,577 discloses a warp-knitted stringer tape comprising elastic laid-in weft yarns connecting pillars of stitches in the web portion of the tape and non-elastic laid-in weft yarns connecting pillars of stitches in one edge portion of the tape, the yarns meeting alternately in one or two pillars to connect the web and edge portions. Yarns may be polyurethane and the tape may be reinforced by laid-in warps or by yarns forming a tricot pattern. Elements are secured by sewing to the longitudinal edge.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of a garment comprising a fabric portion having an inner face that is configured to contact a wearer's body while the garment is worn. The fabric portion is configured to be stretched while the garment is worn on the wearer's body. A coefficient of friction of the inner face of the fabric portion is greater while the fabric portion is stretched on the wearer's body than while the fabric portion is not stretched.

Another example of the present disclosure is of a garment comprising a garment portion having an inner face that is configured to contact a wearer's body while the garment is worn on the wearer's body. The inner face of the garment portion has an unstretched coefficient of friction while no tensile force is applied thereto, and the inner face of the garment portion has a stretched coefficient of friction while a tensile force is applied thereto. The stretched coefficient of friction is greater than the unstretched coefficient of friction.

BRIEF DESCRIPTION OF THE DRAWINGS

The present disclosure is described with reference to the following Figures. The same numbers are used throughout the Figures to reference like features and like components.

FIG. 5 illustrates tensile testing results for a known 100% spandex fabric.

FIG. 6 illustrates tensile testing results for a known fabric having one face with exposed spandex.

FIG. 7 illustrates tensile testing results for a fabric according to a first embodiment of the present disclosure.

FIG. 8 illustrates tensile testing results for a fabric according to a second embodiment of the present disclosure.

FIG. 9 illustrates tensile testing results for a fabric according to a third embodiment of the present disclosure.

FIG. 10 illustrates tensile testing results for a fabric according to a fourth embodiment of the present disclosure.

FIG. 11 illustrates tensile testing results for a fabric according to a fifth embodiment of the present disclosure.

DETAILED DESCRIPTION

Figure 1:
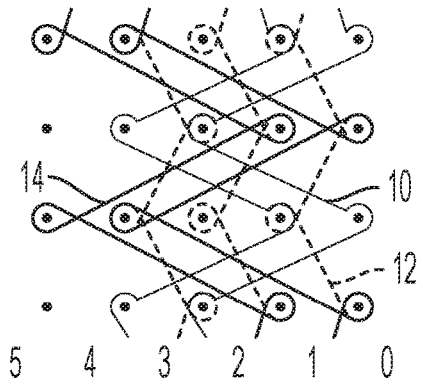
FIG. 1 illustrates one example of a knitting diagram for a fabric according to the present disclosure.

In the present description, certain terms have been used for brevity, clarity and understanding. No unnecessary limitations are to be inferred therefrom beyond the requirement of the prior art because such terms are used for descriptive purposes only and are intended to be broadly construed.

It is desirable for many garments, such as, but not limited to, brassieres, panties, shapewear, athletic wear, yoga wear, swimwear, leggings, and tights to cling tightly to the body when the garment is worn. Such clinging function prevents slipping of the garment with respect to the wearer's body, ensuring the wearer that the garment will stay in place. Currently, such tight-to-body, clinging function is usually accomplished by providing stickiness to the material used to make the garment. However, sometimes the sticky feel is not aesthetically pleasing to a potential buyer/wearer who touches the garment when it is still on the rack/hanger. Nonetheless, the stickiness is required to create friction between the garment and the wearer's body to prevent slipping.

Currently available materials that create such stickiness include fabrics with spandex exposed on one or more faces thereof, polyurethane or thermoplastic polyurethane films and/or coatings, silicone tape, silicone printing, and gel strips. These materials all make the garment feel (and sometimes even look) sticky while on the rack/hanger, before the garment is even worn, and therefore may not be desirable to potential buyers/wearers.

Thus, the present inventors have developed a garment that includes a garment portion (or portions) that is (are) sticky/grippy only when the garment portion is stretched, such as while it is worn on a wearer's body as part of a garment. The garment portion has an inner face that contacts the wearer's body when the garment is worn. When the garment portion is stretched while on the wearer's body, a coefficient of friction of the inner face of the garment portion increases. Thus, the potential buyer/wearer does not feel the stickiness of the garment portion on his or her hand when the garment portion is not stretched. However, when the garment portion is stretched, such as while it is worn, it becomes sticky so it can hold the garment portion to the body well. The present garment portion can therefore be substituted for tight elastic and provides more comfort than elastic while still preventing the garment from moving too much on the body.

The portion of the garment includes at least one of a knitted fabric, a woven fabric, a non-woven fabric, a lace fabric, and/or an elastic band. In some examples, the portion makes up the entire garment. In other examples, the portion makes up only a part of the garment where a higher coefficient of friction is desired and/or required, such as on a bra wing, on a bra cup, on a shoulder strap, in a waistband area, or along a trim line. Each of these areas of a garment is (or can be) designed such that it is meant to be stretched at least to some degree while it is worn on a wearer's body. By way of non-limiting example, a waistband on yoga pants is meant to be stretched while the correct size is worn by a wearer, otherwise the pants would not stay up. So too, a wing on a bra is meant to be stretched while the correct size is worn by a wearer, otherwise the bra would not provide support to the wearer's breasts.

A diagram of one example of a knitted fabric that exhibits desirable stickiness when stretched is shown in FIG. 1. The fabric is made of a first yarn 10, a second yarn 12, and a third yarn 14, warp knitted together as shown. The first and third yarns 10, 14 are lapped over several wales, with the third yarn 14 being lapped over four wales and three courses to form longer loops than either the loops of the first yarn 10 or the second yarn 12. Although the first yarn 10 is shown as being lapped over three wales and three courses, it could instead be lapped over fewer wales and/or courses. For example, the first yarn 10 could be lapped opposite the second yarn 12, over one wale and one course. In general, the first and second yarns 10, 12 are knit such that they form a fabric background for the longer loops of the third yarn 14, as will be described further herein below.

In another example, the first and second yarns 10, 12 are weft knit together. More specifically, the weft knit can be, for example, single-sided plain knit (e.g., single jersey knit). The third yarn 14 is in a plated relationship with the first yarn 10, and the third yarn 14 is knitted with float stitches to form the above-mentioned longer loops. In one example, three stitches of the third yarn 14 are floated for every knit stitch in a row. In the following row, the knit stitch of the third yarn 14 is offset by two stitches such that the knit stitch is centered on the three floated stitches in the row above. Such a repeating pattern forms longer loops of the third yarn 14.

In both examples, the first yarn 10 can be a non-sticky yarn; the second yarn 12 can be a finer (lower denier) intrinsically sticky yarn or a non-sticky yarn; and the third yarn 14 can be a heavier (higher denier) intrinsically sticky yarn. A finer intrinsically sticky yarn has a lower denier in comparison to the denier of a heavier intrinsically sticky yarn, rather than the weights being considered objectively low or high.

In a first embodiment of the fabric according to FIG. 1, the first yarn 10 is polyamide (e.g., nylon) 20D/20F semi-dull drawn textured yarn, the second yarn 12 is polyurethane (e.g., spandex) 30D, and the third yarn 14 is polyurethane (e.g., spandex) 70D.

In a second embodiment of the fabric according to FIG. 1, the first yarn 10 is polyamide (e.g., nylon) 20D/20F semi-dull drawn textured yarn. The second yarn 12 is made of polyurethane (e.g., spandex) 30D. The third yarn 14 is also made of polyurethane (e.g., spandex), but is 55D.

In a third embodiment of the fabric according to FIG. 1, the first yarn 10 is polyamide (e.g., nylon) 20D/20F semi-dull drawn textured yarn. The second yarn 12 is made of polyurethane (e.g., spandex) 30D. The third yarn 14 is also made of polyurethane (e.g., spandex), but is 40D.

In a fourth embodiment, the first yarn 10 is polyamide (e.g., nylon) 12D/12F semi-dull drawn textured yarn. The second yarn 12 is made of polyurethane (e.g., spandex) 30D. The third yarn 14 is polyurethane (e.g., spandex) 40D. In a fifth embodiment, the first yarn 10 is polyamide (e.g., nylon) 12D/10F semi-dull drawn textured yarn. The second yarn 12 is made of polyurethane (e.g., spandex) 30D. The third yarn 14 is polyurethane (e.g., spandex) 40D. In both the fourth and fifth embodiments, using finer nylon thread results in a more sheer fabric than the fabric of the first, second, and third embodiments.

Note that yarn of other types than those described herein could be used. For example, the first yarn 10 could be polyester, polybutylene terephthalate (PBT), polytrimethylene terephthalate (PTT), or PTT/PET (polyethylene terephthalate) side-by-side composite yarn. The first yarn 10 could be drawn textured yarn (DTY), air textured yarn (ATY), or short staple yarn (SSY). The second and third yarns 12, 14 could be polyurethane, such as spandex (elastane) or thermoplastic polyurethane (TPU); latex; or silicone. Alternatively, the second yarn 12 could be any stretch yarn. The same material need not be used for both the second yarn 12 and the third yarn 14, but the third yarn 14 should be one that is intrinsically sticky (i.e., has a high coefficient of friction), such as the above-mentioned polyurethane, latex, or silicone. The yarns 10, 12, 14 could be mono- or multi-filament or could be wrapped or blended yarns. For example, in any of the embodiments noted herein above, the 30D, 40D, 55D, and 70D polyurethane yarns may be monofilament yarns. The linear density of any of the yarns 10, 12, 14 could vary from that noted herein.

Figure 2:
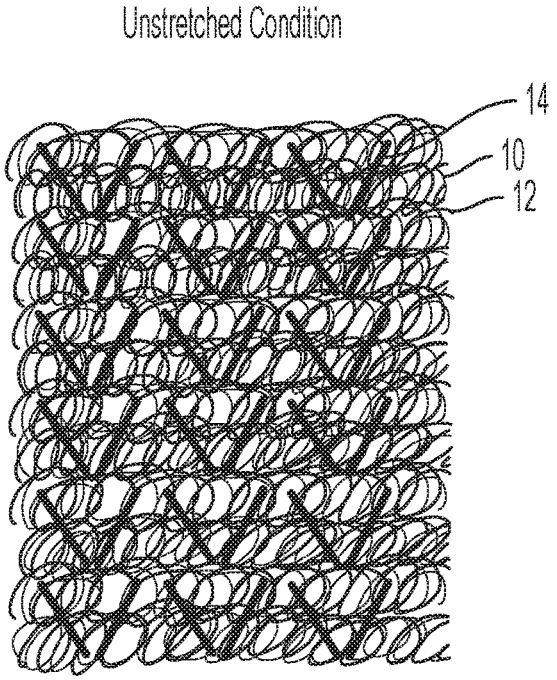
FIG. 2 illustrates a schematic of a fabric of the present disclosure in a rest state.
Figure 3:
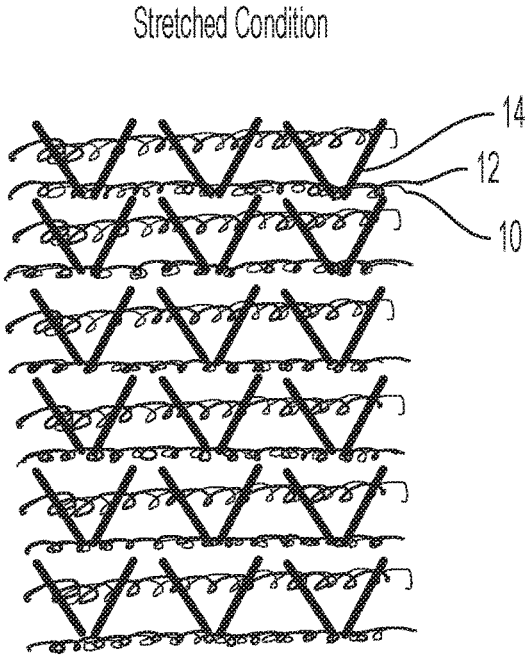
FIG. 3 illustrates a schematic of the fabric of FIG. 2 in a stretched state.

Now referring to FIGS. 2 and 3, schematics of another example of fabric knitted according to the present disclosure are included, wherein the fabric is shown in an unstretched configuration (FIG. 2) and a stretched configuration (FIG. 3). When the fabric is not stretched, the first and second yarns 10, 12 are bunched up due to their stretchiness and the way they are knit together. The bunched up first and second yarns 10, 12 are fluffy, especially in their unstretched/bunched configuration, and therefore their fibers/filaments can reach the outside surface of the fabric through the gaps in the fabric structure that exist between the longer loops of the intrinsically sticky third yarn 14. (Such fluffiness may be provided or enhanced by the first yarn 10 being DTY, ATY, or SSY.) However, when the fabric is stretched (i.e., a tensile force is applied thereto), the loops created by the first and second yarns 10, 12 stretch and elongate, and the longer loops of the intrinsically sticky third yarn 14 will be exposed and slightly raised from the fabric background as the fibers/filaments first and second yarns 10, 12 recede from the gaps and cover less of the third yarn 14. Thus, in the embodiments provided, the intrinsically sticky third yarn 14 is mostly or fully covered by the fibers/filaments of non-sticky yarn, such as the first yarn 10, when the fabric is not stretched, and is at least partially exposed when the fabric is stretched. This means that the fabric does not feel sticky to the touch when it is not stretched, but does feel sticky to the touch when it is stretched.

The present inventors conducted friction testing on five exemplary fabrics knitted according to the diagram described herein above and compared the test data to two different known sticky fabrics. The first known fabric is a fabric made from 100% spandex, and the second known fabric has spandex exposed on at least one face thereof while the fabric is not stretched. The seven fabrics were tested at each of the following states: rest (not stretched), stretched to 20% times the original length, stretched to 40% times the original length, and stretched to 100% times the original length.

The test method used measures fabric surface friction coefficients as maximum static friction and/or kinetic friction. The test method produces objective measurements of the properties of knitted and woven elastic fabrics. The present tests were performed by a constant-rate-of-extension (CRE)-type tensile testing machine.

Each of the below tests was performed on each of the four fabrics.

- L-L (stretch in Length direction; test friction in Length direction)
- W-W (stretch in Width direction; test friction in Width direction)
- L-W (stretch in Length direction; test friction in Width direction)
- W-L (stretch in Width direction; test friction in Length direction)

Each test was performed on each fabric five times at each percent elongation, and the average kinetic friction coefficient was taken from the five test results. This methodology reduces the coefficient of variation to below 5, thereby ensuring testing accuracy.

Figure 4:
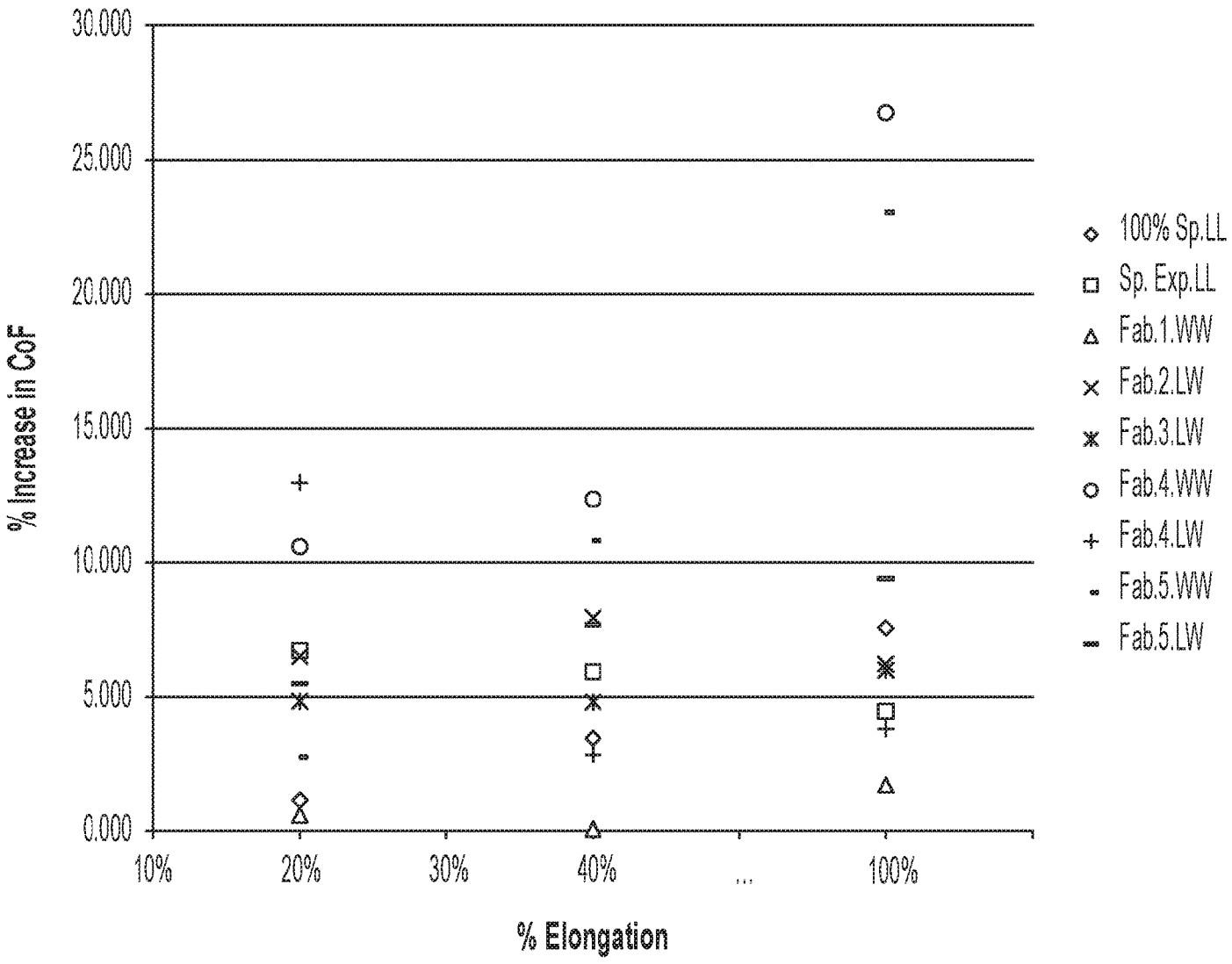
FIG. 4 illustrates percent elongation versus percent increase in coefficient of friction for two known fabrics and five exemplary fabrics according to the present disclosure.

The average kinetic friction coefficient for each fabric at 20%, 40%, and 100% elongation was then compared to the average kinetic friction coefficient of the respective fabric at rest. The percent increase in the coefficient of friction was then determined with respect to the rest/non-stretched state for each fabric at each elongation. Results for the highest percent increases in coefficient of friction per percent elongation for each fabric are plotted in FIG. 4.

The testing results for the known 100% spandex fabric are shown in FIG. 5. It can be seen by the shaded cells that the 100% spandex fabric has an increased coefficient of friction when stretched/tested in the L-L direction.

The results for the known fabric with spandex exposed on at least one face are shown in FIG. 6. It can be seen by the shaded cells that the spandex exposed fabric also has an increased coefficient of friction when stretched/tested in the L-L direction.

The results for the fabric of the first embodiment of the present disclosure knitted according to FIG. 1, wherein the third yarn 14 is 70D spandex, are shown in FIG. 7. It can be seen by the shaded cells that the fabric of the first embodiment of the present disclosure has a slightly increased coefficient of friction when stretched/tested in the W-W direction.

The results for the fabric according to the second embodiment of the present disclosure knitted according to FIG. 1, wherein the third yarn 14 is 55D spandex, are shown in FIG. 8. It can be seen by the shaded cells that the fabric of the second embodiment of the present disclosure has an increased coefficient of friction when stretched/tested in the L-W direction.

The results for the fabric according to the third embodiment of the present disclosure knitted according to FIG. 1, wherein the third yarn 14 is 40D spandex, are shown in FIG. 9. It can be seen by the shaded cells that the fabric of the third embodiment of the present disclosure has an increased coefficient of friction when stretched/tested in the L-W direction.

Comparison of FIGS. 7, 8, and 9 shows that when the intrinsically sticky third yarn 14 is too heavy or too fine in comparison to the first and second yarns 10, 12, the coefficient of friction does not increase by very much. Thus, the medium denier third yarn 14 (i.e., spandex of 55D) shows the highest increase in coefficient of friction of these three examples when knitted with nylon 20D/20F semi-dull drawn textured yarn as the first yarn 10 and spandex 30D yarn as the second yarn 12. Compare the W-W average percent increases in CoF for the fabric of the first embodiment (FIG. 7), the L-W average percent increases in CoF for the fabric of the second embodiment (FIG. 8), and the L-W average percent increases in CoF for the fabric of the third embodiment (FIG. 9). However, it may be desirable to decrease the weight and increase the sheerness of the fabric when it is to be used as a portion of certain garments, such as brassieres and other lingerie.

Figure 12:
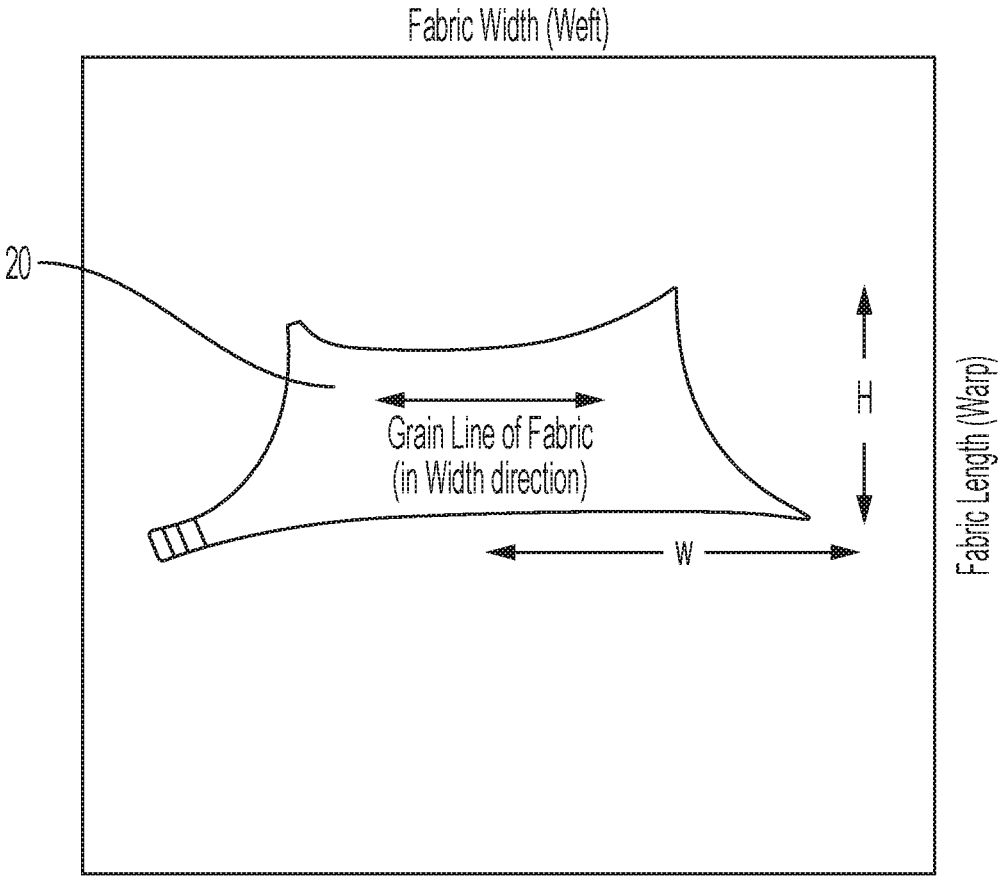
FIG. 12 illustrates a wing portion of a brassiere according to the present disclosure.

For example, FIG. 12 shows a sample wing 20 for a brassiere. The fabric width (weft direction) and fabric length (warp direction) are labeled in order to provide an idea of the elongation and testing directions referred to herein above with respect to FIGS. 5-11. The alignment of the fabric length and fabric width with respect to the brassiere wing 20 allows another observation to be made. For a brassiere wing 20, it is desirable for the fabric to have a high CoF in either or both of the height direction H and the width direction W so that it stays in place with respect to the wearer's body. The height direction H of the wing 20 corresponds to the fabric length, and the width direction W of the wing 20 corresponds to the fabric width, at least in the orientation shown here. When a brassiere wing 20 is worn, the wing 20 is stretched in both the height H and width W directions, although more so in the width direction W than the height direction H, as the wing 20 wraps around the wearer's body. Thus, it is desirable for the stretching in the width direction W of the wing 20 to produce an increase in the CoF of the wing fabric. As noted herein above with respect to FIG. 8, the fabric of the second embodiment of the present disclosure shows an increase in the CoF in the fabric width direction (this is also the width direction W of the wing 20) when stretched in the fabric length direction (which is the wing height direction H). Thus, the present inventors continued research and development to improve the percent increase in the CoF of the fabric in the W-W and/or the W-L direction to correspond more to the way the wing 20 will be stretched when worn as part of a brassiere. Specifically, the present inventors worked to improve the increase in CoF when the fabric is stretched at 20% to 40% elongation in the width direction of the fabric, which is also the width direction W of the wing 20. The resulting fabrics according to the fourth and fifth embodiments of the present disclosure met the inventors' performance criteria for increased grip in the width direction of the fabric when stretched in the width direction of the fabric.

The results for the fabric according to the fourth embodiment of the present disclosure knitted according to FIG. 1, wherein the first yarn 10 is 12D/12F nylon, the second yarn 12 is 30D spandex, and the third yarn 14 is 40D spandex, are shown in FIG. 10. It can be seen by the shaded cells that the fabric of the fourth embodiment of the present disclosure has an increased coefficient of friction when stretched/tested in the W-W direction and when stretched/tested in the L-W direction.

The results for the fabric according to the fifth embodiment of the present disclosure described with respect to FIG. 1, wherein the first yarn 10 is 12D/10F nylon, the second yarn 12 is 30D spandex, and the third yarn 14 is 40D spandex are shown in FIG. 11. It can be seen by the shaded cells that the fabric of the fifth embodiment of the present disclosure has an increased coefficient of friction when stretched/tested in the W-W direction and when stretched/tested in the L-W direction.

Note that none of the seven tested fabrics have a percent increase in the coefficient of friction in all four different stretched/tested directions (i.e., all four of L-L, W-W, L-W, and W-L). However, among these five tested fabrics according to the present disclosure, the fabric of the second embodiment of the present disclosure, which uses 20D/20F nylon as the first yarn 10 and 55D spandex as the third yarn 14, and the fabric of the third embodiment of the present disclosure, which uses 20D/20F nylon as the first yarn 10 and 40D spandex as the third yarn 14, have slightly more stable and consistent percent increases in the coefficient of friction (CoF) when stretched than do the prior art fabrics or the fabric of the first embodiment. This is shown by the compared results in FIG. 4, which shows the testing results for the 100% spandex fabric in the L-L direction, the spandex exposed fabric in the L-L direction, the first embodiment (70D spandex) of the present disclosure in the W-W direction, the second embodiment (55D spandex) of the present disclosure in the L-W direction, and the third embodiment (40D spandex) of the present disclosure in the L-W direction. While the 100% spandex fabric shows an increase in CoF in the length direction as elongation in the length direction increases, the spandex exposed fabric shows a decrease in CoF in the length direction as elongation increases in the length direction. In contrast, the fabric of the second embodiment of the present disclosure shows an increase in CoF in the width direction above 6% at all elongations in the length direction, and the fabric of the third embodiment of the present disclosure shows an increase in CoF in the width direction above 4.5% at all elongations in the length direction.

While the fabrics of the fourth and fifth embodiments of the present disclosure may not show as stable of increases in the CoF when stretched as do the fabrics of the second and third embodiments, they do show increases in the CoF in multiple directions when stretched in multiple directions. Additionally, as percent elongation approaches 100%, the fabrics of the fourth and fifth embodiments show the highest increase in CoF overall. See the comparative test data in FIG. 4 for the fabric of the fourth embodiment in the W-W stretch-test direction and for the fabric of the fifth embodiment in the W-W and L-W stretch-test directions. Thus, it is possible for the fabric to be made lighter and sheerer than the fabrics of the second or third embodiments without compromising on the increase in CoF when the fabric is stretched.

By comparison of the test data, it can also be seen that all kinetic CoFs at rest for the fabrics of the second embodiment (FIG. 8), the third embodiment (FIG. 9), the fourth embodiment (FIG. 10) and the fifth embodiment (FIG. 11) of the present disclosure are less than all kinetic CoFs at rest for the known spandex-exposed fabric (FIG. 6). This proves that the fabrics of the second, third, fourth, and fifth embodiments of the present disclosure feel (and are) less sticky when at rest than does (is) the known spandex-exposed fabric. Additionally, although the 100% spandex fabric has the second lowest kinetic CoF at rest of all tested fabrics (except for that of the fourth embodiment), the 100% spandex fabric also has lower percent increase in CoF at 20% and 40% elongation (L-L average percent increases) than do the fabrics of the second embodiment (L-W average percent increases), third embodiment (L-W average percent increases), fourth embodiment (W-W average percent increases), and fifth embodiment (L-W average percent increases) of the present disclosure. The 100% spandex fabric also has a lower percent increase in CoF at 100% elongation (L-L average percent increase) than do the fabrics of the fourth embodiment (W-W average percent increase) and fifth embodiment (both W-W and L-W average percent increases) of the present disclosure. See FIG. 4. Thus, the fabrics of the second, third, fourth, and fifth embodiments of the present disclosure have better overall stickiness performance when stretched than does the 100% spandex fabric.

Figure 13:
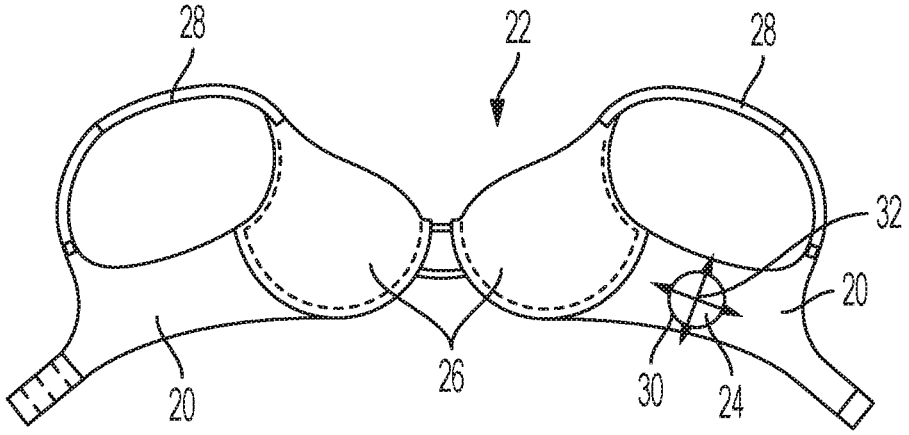
FIG. 13 illustrates the wing portion as part of a brassiere, and as being stretched in a testing area.

Referring to FIG. 13, the present disclosure is therefore of a garment (for example, a brassiere 22) comprising a fabric portion 24 having an inner face that is configured to contact a wearer's body while the garment is worn. Here, the visible side of the brassiere 22 is the side configured to contact the wearer's body while the brassiere 22 is worn. The fabric portion 24 is configured to be stretched while the garment 22 is worn on the wearer's body. A coefficient of friction of the inner face of the fabric portion 24 is greater while the fabric portion 24 is stretched on the wearer's body than while the fabric portion 24 is not stretched. The fabric portion 24 comprises an intrinsically sticky yarn 14. According to one example, the intrinsically sticky yarn 14 comprises polyurethane. In one specific example, the intrinsically sticky yarn 14 is spandex yarn. The spandex yarn can be 40 denier monofilament, although it could range anywhere from 30D to 80D. In other examples, the intrinsically sticky yarn 14 is thermoplastic polyurethane (TPU), latex, or silicone, although these examples are not meant to be limiting, and any yarns with a high coefficient of friction could be used. The fabric portion 24 further comprises a non-intrinsically sticky yarn 10 that is configured to at least partially cover the intrinsically sticky yarn 14. The non-intrinsically sticky yarn 10 covers the intrinsically sticky yarn 14 more while the fabric portion 24 is not stretched than while the fabric portion 24 is stretched. The non-intrinsically sticky yarn 10 could be nylon, polyester, polybutylene terephthalate (PBT), polytrimethylene terephthalate (PTT), or PTT/PET (polyethylene terephthalate) side-by-side composite yarn. The non-intrinsically sticky yarn could be draw textured yarn, air textured yarn, or short staple yarn.

The fabric portion 24 comprises at least one of a knitted fabric, a woven fabric, a non-woven fabric, a lace fabric, and/or an elastic band. In on example, the fabric portion 24 is a warp knitted fabric. The fabric portion 24 comprises an intrinsically sticky yarn 14 that is knitted with longer loops on a background of shorter loops, and the intrinsically sticky yarn 14 is raised from the background when the fabric portion 24 is stretched.

In one example, the garment is a brassiere 22, and the fabric portion 24 is used in at least one of a wing 20, a cup 26, and a strap 28 of the brassiere.

According to another example, a garment (such as brassiere 22) comprises a garment portion (such as wing 20) having an inner face that is configured to contact a wearer's body while the garment is worn on the wearer's body. The inner face of the garment portion 20 has an unstretched coefficient of friction while no tensile force is applied thereto, and the inner face of the garment portion 20 has a stretched coefficient of friction while a tensile force is applied thereto. The stretched coefficient of friction is greater than the unstretched coefficient of friction. The garment 22 is configured such that tensile force is applied to the garment portion 20 while the garment 22 is worn on the wearer's body. The garment portion 20 comprises an intrinsically sticky yarn 14. According to one example, the intrinsically sticky yarn 14 comprises polyurethane. In other examples, the intrinsically sticky yarn 14 is latex or silicone, although these examples are not meant to be limiting, and any yarns with a high coefficient of friction could be used. The garment portion 20 further comprises a non-intrinsically sticky yarn 10 that is configured to at least partially cover the intrinsically sticky yarn 14. The non-intrinsically sticky yarn 10 covers the intrinsically sticky yarn 14 more when no tensile force is applied to the garment portion 20 than while tensile force is applied to the garment portion 20. The non-intrinsically sticky yarn 10 could be nylon, polyester, polybutylene terephthalate (PBT), polytrimethylene terephthalate (PTT), or PTT/PET (polyethylene terephthalate) side-by-side composite yarn. The non-intrinsically sticky yarn 10 could be draw textured yarn, air textured yarn, or short staple yarn.

The garment portion 20 comprises at least one of a knitted fabric, a woven fabric, a non-woven fabric, a lace fabric, and/or an elastic band. In one example, the garment portion 20 is made of a warp knitted fabric. The stretched coefficient of friction is greater than the unstretched coefficient of friction while tensile force is applied in a warp direction of the warp knitted fabric and while tensile force is applied in a weft direction of the warp knitted fabric. In fact, the stretched coefficient of friction is greater than the unstretched coefficient of friction while tensile force is applied in 360 degrees, as shown by the testing area 30 and arrows 32 in all directions in FIG. 13.

According to one example, the garment portion 20 comprises an intrinsically sticky yarn 14 that is knitted with longer loops on a background of shorter loops, and the intrinsically sticky yarn 14 is raised from the background when tensile force is applied the garment portion.

In one example, the garment is a brassiere 22, and the garment portion is used in at least one of a wing 20, a cup 26, and a strap 28 of the brassiere 22.

Note that the fabric of the present disclosure does not need to be stretched in a particular direction for the stickiness (increase in CoF) to be created/realized, although greater increases in CoF may be seen if the stretch is in a particular direction. Instead, when the fabric is stretched in any direction, or in all directions at once (360 degrees inside testing area 30, see FIG. 13), an increase in the CoF is seen. Additionally, note that the stickiness is exposed by stretching, but is not present to as high of a degree when the fabric is at rest. Additionally, the stickiness is only on one side of the fabric, thus ensuring that the outer face of the garment portion does not feel sticky when the garment portion is stretched. Instead, only the inner face that touches the wearer's body has an increased CoF when the garment portion is stretched. This is facilitated by certain examples of the present fabric being single-sided knitted fabrics.

Because a garment including a portion made from the fabric of the present disclosure is not sticky when it is at rest, potential buyers/wearers will not expect of this type of hidden benefit when they touch the garment. However, when they wear the garment, they will feel the tight-to-skin, clinging property of the garment portion. Additionally, the present garment portion provides more comfort than tight elastic, while still preventing the garment from moving on the body as well as or better than elastic. Thus, garment portions including the fabric of the present disclosure achieve function and comfort at the same time.

Note that the portion of the garment that exhibits an increased CoF when stretched need not be made entirely (or at all) of a knitted fabric. The garment portion can additionally or alternatively comprise a woven fabric, a non-woven fabric, an elastic band, and/or lace. Similar to the knitted fabric described herein above, the woven fabric, non-woven fabric, elastic band or the lace would have a structure that exposes an intrinsically sticky yarn when the woven fabric, non-woven fabric, elastic band, or lace is stretched or placed under tension, which intrinsically sticky yarn is less exposed when the garment portion is not stretched.

The garment and/or portion thereof could be any type of garment for which a tight-to-skin feel and clinging effect is desirable, not just a bra wing as illustrated in FIG. 12. For example, the garment portion might be in a waistband area or along the trim of leggings, panties, or a swimsuit bottom. The garment portion might be along a bottom band of a brassiere or a swimsuit top. The garment portion could be a strap of a brassiere, camisole, or tank top. The garment portion might instead or also be a bra cup. It should be understood that each of these areas of a garment is intended to be stretched when it is worn in a correct size by a wearer. It should also be understood that the above-noted garments could be intended to be worn during exercise, such as a sports bra or tank top or other athletic wear. In any instance where the garment portion is made of fabric, the fabric can be raw cut along its edges, allowing a maximum surface area of the garment portion to touch the wearer's skin.

In the above description, certain terms have been used for brevity, clarity, and understanding. No unnecessary limitations are to be inferred therefrom beyond the requirement of the prior art because such terms are used for descriptive purposes and are intended to be broadly construed. The different garments, garment portions, and fabrics described herein may be used alone or in combination with other garments and/or fabrics. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A garment comprising:

a fabric portion having an inner face that is configured to contact a wearer's body while the garment is worn;

the fabric portion being configured to be stretched while the garment is worn on the wearer's body;

wherein a coefficient of friction of the inner face of the fabric portion is greater while the fabric portion is stretched on the wearer's body than while the fabric portion is not stretched; and wherein the fabric portion comprises an intrinsically sticky yarn that is knitted with longer loops on a background of shorter loops, and the intrinsically sticky yarn is raised from the background when the fabric portion is stretched.

2. The garment of claim 1, wherein the fabric portion further comprises a non-intrinsically sticky yarn that is configured to at least partially cover the intrinsically sticky yarn;

the non-intrinsically sticky yarn covering the intrinsically sticky yarn more while the fabric portion is not stretched than while the fabric portion is stretched.

3. The garment of claim 1, wherein the intrinsically sticky yarn comprises polyurethane.

4. The garment of claim 3, wherein the intrinsically sticky yarn is spandex yarn.

5. The garment of claim 4, wherein the spandex yarn is 40 Denier monofilament.

6. The garment of claim 1, wherein the fabric portion comprises a knitted fabric, a woven fabric, a non-woven fabric, a lace fabric, and/or an elastic band.

7. The garment of claim 1, wherein the fabric portion is a warp knitted fabric.

8. The garment of claim 1, wherein the garment is a brassiere, and the fabric portion is used in a wing, a cup, and/or a strap of the brassiere.

9. A garment comprising:

a garment portion having an inner face that is configured to contact a wearer's body while the garment is worn on the wearer's body;

wherein the inner face of the garment portion has an unstretched coefficient of friction while no tensile force is applied to the garment portion, the inner face of the garment portion has a stretched coefficient of friction while a tensile force is applied to the garment portion, and the stretched coefficient of friction is greater than the unstretched coefficient of friction; and wherein the garment portion comprises an intrinsically sticky yarn that is knitted with longer loops on a background of shorter loops, and the intrinsically sticky yarn is raised from the background while tensile force is applied to the garment portion.

10. The garment of claim 9, wherein the garment is configured such that tensile force is applied to the garment portion while the garment is worn on the wearer's body.

11. The garment of claim 9, wherein the garment portion further comprises a non-intrinsically sticky yarn that is configured to at least partially cover the intrinsically sticky yarn;

the non-intrinsically sticky yarn covering the intrinsically sticky yarn more while no tensile force is applied to the garment portion than while tensile force is applied to the garment portion.

12. The garment of claim 9, wherein the intrinsically sticky yarn comprises polyurethane.

13. The garment of claim 9, wherein the garment portion comprises a knitted fabric, a woven fabric, a non-woven fabric, a lace fabric, and/or an elastic band.

14. The garment of claim 9, wherein the garment portion is made of a warp knitted fabric.

15. The garment of claim 14, wherein the stretched coefficient of friction is greater than the unstretched coefficient of friction while tensile force is applied in a warp direction of the warp knitted fabric and while tensile force is applied in a weft direction of the warp knitted fabric.

16. The garment of claim 9, wherein the garment is a brassiere, and the garment portion is used in a wing, a cup, and/or a strap of the brassiere.

* * * * *